United States Patent [19]

Ruh

[11] Patent Number: 4,458,893

[45] Date of Patent: Jul. 10, 1984

[54] DRIVE FOR SHEET FEEDER IN PRINTING PRESS

[75] Inventor: Jurgen Ruh, Heusenstamm, Fed. Rep. of Germany

[73] Assignee: M.A.N. Roland Druckmaschinen Aktiengesellschaft, Fed. Rep. of Germany

[21] Appl. No.: 423,168

[22] Filed: Sep. 24, 1982

[30] Foreign Application Priority Data

Sep. 28, 1981 [DE] Fed. Rep. of Germany ..... 3138540

[51] Int. Cl.[3] ..... B65H 5/02

[52] U.S. Cl. ..... 271/277; 101/248; 226/30; 271/82

[58] Field of Search ..... 271/277, 276, 275, 270, 271/82, 268; 101/181, 248; 226/27, 30, 42, 43

[56] References Cited

U.S. PATENT DOCUMENTS 3,443,808 5/1969 Siebke ..... 271/82

3,510,036 5/1970 Lewis, Jr. et al. ..... 226/30

FOREIGN PATENT DOCUMENTS 2415909 10/1974 Fed. Rep. of Germany .

*Primary Examiner*—Bruce H. Stoner, Jr.

*Assistant Examiner*—John A. Carroll

*Attorney, Agent, or Firm*—Leydig, Voit, Osann, Mayer & Holt, Ltd.

[57] ABSTRACT

A sheet fed printing press having an impression cylinder with a feed board presenting a sheet with its leading edge in a position for pick up. A rotary sheet feeder is interposed between the feed board and the impression cylinder for picking up the leading edge of the sheet from its stationary position and transferring the leading edge to grippers on the moving impression cylinder. The sheet feeder is directly driven by a high powered electric motor. High resolution pick up heads and associated angle coders produce output signals respectively representative of the phase position of the cylinder and sheet feeder. A programmed phase offset device is provided defining a predetermined relation of desired feeder phase as a function of impression cylinder phase. A comparator constantly compares the relation of the signals from the angle coders to the desired relation stored in the programmed phase offset device and produces a control signal which is representative of any current difference between the two relations. An amplifier is interposed between the comparator and the electric motor for correctively energizing the motor so that the feeder is driven in the currently desired phase relation.

4 Claims, 3 Drawing Figures

DRIVE FOR SHEET FEEDER IN PRINTING PRESS

In a sheet fed printing press a rotary feeder is interposed between the feed board and impression cylinder for engaging the leading edge of the stationary sheet on the feed board and for transferring it to the grippers on the rotating impression cylinder. Such feeder may be in the form of a revolving drum or may be of the "swing" type oscillating back and forth through an angle of less than 360°. Both types of feeders may, for present purposes, be considered "rotary". They have in common the fact that their velocity in the course of an operating cycle is not constant. At modern press speeds this gives rise to high accelerational and decelerational forces during each operating cycle. Where the rotary feeder is driven by the main press drive through such mechanical elements as gears, cams and levers, as is the common practice, the accelerational and decelerational forces are reflected in variations in the speed of the press drive which have a degrading effect upon the quality of the printed product.

It is, accordingly, an object of the present invention to provide a rotary feeder which is driven by an electric motor at a relative phase, with respect to the impression cylinder, which constantly varies in accordance with a program which is stored in a computer, the electric motor being sufficiently powerful to accelerate the feeder, and to resist the forces of deceleration of the feeder, so that the feeder precisely follows the program of cyclical movement, and with the motor being entirely independent of the press drive so that changes in the loading upon the motor are isolated from the press drive permitting the latter to rotate at a more constant speed.

Thus it is a general object of the invention to provide a drive for a rotary feeder in a sheet fed printing press which improves the quality of the printed product but which is at the same time highly economical, inherently long-lived and maintenance-free. In this connection it is an object to provide a novel drive for a feeder in a sheet fed press which avoids the wear, noise and vibration which characterizes feeder drives of the conventional mechanical type.

Other objects and advantages of the invention, will become apparent upon reading the attached detailed description and upon reference to the drawing in which.

Figures 1, 2, 3:
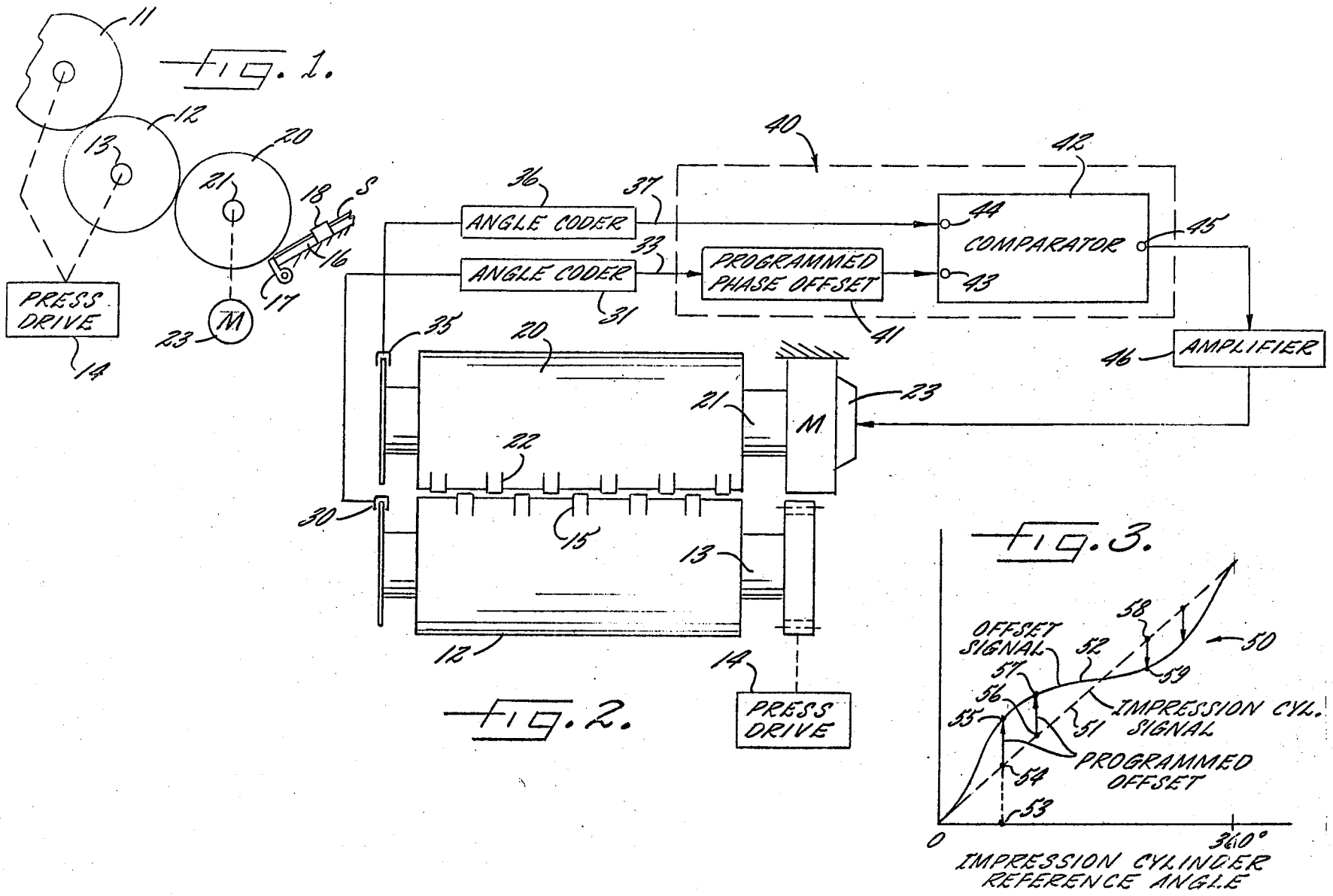
FIG. 1 is a fragmentary elevational diagram showing an impression cylinder, feed board and interposed rotary feeder employed in a typical sheet fed press.
FIG. 2 is a schematic diagram showing the drive for the electric motor employed in FIG. 1.
FIG. 3 is a plot showing the programmed phase of the rotary feeder for storage in the computer of FIG. 2.

While the invention has been described in connection with a preferred embodiment, it will be understood that the invention is not limited to the particular embodiment described, but it is intended, on the contrary, to cover the various alternative and equivalent forms of the invention included within the spirit and scope of the appended claims.

Turning now to FIGS. 1 and 2 there is shown a blanket cylinder 11 in a press of the sheet-fed type cooperating with an impression cylinder 12 having a shaft 13 driven by a press drive 14 and fitted with grippers 15. Arranged opposite the impression cylinder is a feed board 16 having the usual front and side stops 17, 18 for positioning a sheet S with its leading edge in a predetermined stationary position for pick-up. Interposed between the feed board and the impression cylinder is a rotary sheet feeder 20 having a shaft 21 and having a set of transfer grippers 22 for sequentially picking up the leading edge of the sheet S from its stationary position and transferring the leading edge of the sheet to the grippers 15 on the moving impression cylinder. The rotary sheet feeder 20 is driven by an electric motor 23.

In accordance with the present invention high resolution pick-up heads and associated angle coders are respectively coupled to the impression cylinder and rotary sheet feeder for producing output signals representative of the phase position of the cylinder and sheet feeder. A computer is provided including programmed phase offset means defining a continuously varying but predetermined relation of desired feeder phase as a function of the impression cylinder phase. A comparator, included in the computer, accepts the angle coder outputs for continuously comparing (1) the relation of the signal from the sheet feeder angle coder to the signal from the impression cylinder angle coder to (2) the desired relation stored in the programmed phase offset means for producing a control signal which is representative of any current difference between the two relations. Such control signal, in amplified form, is used to correctively energize the motor to continuously establish the desired programmed relation between the feeder and impression cylinder, the motor being entirely independent of the press drive so that the changes in loading upon the motor resulting from the acceleration and deceleration of the sheet feeder are isolated from the press drive permitting the latter to rotate at a more constant speed.

Thus coupled to the shaft 13 of the impression cylinder is an angle pick-up head 30 which feeds an angle coder 31, the head and coder, together, being of the high resolution type to provide a signal on a line 33 which is representative of the phase of the impression cylinder. Similarly there is provided on the shaft 21 of the sheet feeder a pick-up head 35 feeding an angle coder 36 having an output line 37 which carries a signal representative of the phase position of the feeder. The angle coders feed into a computer 40 which includes a programmed phase offset device, or converter, and a comparator 42 having input terminals 43, 44 and an output terminal 45. The output is fed to an amplifier 46 which in turn energizes the motor 23.

The program which is stored in the programmed converter 41 has been diagrammatically illustrated in the plot 50 in FIG. 3 and which is to be taken as simply representative of various specific programs of feeder motion which may be employed. FIG. 3 relates the constant motion of the impression cylinder during each cycle to the desired variable rotary motion of the sheet feeder. Thus the impression cylinder reference angle over 360°, as abscissa, is plotted against (1) the signal representing the phase angle of the impression cylinder indicated by the dashed line 51 and (2) the signal representing the desired phase angle of the feeder motion indicated by the solid line 52, which may be conveniently referred to as the offset signal. It will be understood that if the sheet feeder were simply geared to the impression cylinder they would be locked in a constant phase relation and the signals representing the phase angle would both follow a straight dashed line 51. However, the sheet feeder requires special programmed motion. Stated in the simplest terms, the programmed converter 41, forming a portion of the computer 40, is so constructed that when it receives an input signal 51 on its input terminal, it will produce an output signal 52 corresponding thereto, which output signal is utilized as a reference signal (at 43) to be compared with the signal (at 44) representative of the actual position of the sheet feeder. The resulting control signal correctively drives electric motor 23 to cause the feeder 20 to have a predetermined, desired, yet constantly varying, phase with respect to the phase of the impression cylinder 12.

The medium in the computer whereby the program illustrated in FIG. 3 is stored is immaterial and any type of programmable storage device may be used. Suppose, for example, that the impression cylinder bears an angle indicated at 53 with respect to an assumed origin or reference position. Such angle has a crossing point 54 with the line 51 representing the impression cylinder signal. The converter is programmed, when it receives an input signal indicated at 54, to "offset" the signal so that it is increased to a level 55 at the output of the converter. Similarly, when the input signal rises to the level 56 the output signal of the converter is programmed to rise to the level 57. Note, however that the programmed offset may be plus or minus. In the example, when the input signal at the programmed converter rises to the level 58 the program introduces a downward offset so that the output signal of the converter is at the level 59. This process, repeated point by point, produces an envelope of output signal relating the phase position of the sheet feeder to the phase position of the impression cylinder used as a reference. In short, the converter produces an output signal which is modified in accordance with the stored program of modification point by point over the entire 360° cycle, which cycle is endlessly repeated.

In carrying out the present invention two signals are applied to the comparator 42. The first signal, applied to the input terminal 43, is the converted, or offset, signal 52 (FIG. 3) received from the output of the converter and which represents the *intended* phase angle of the sheet feeder 20. The second signal, applied to input terminal 44, is the signal which represents the *actual* instantaneous phase angle of the sheet feeder. The comparator 42, as its name implies, algebraically compares the input signals simultaneously existing at the input terminals 43, 44 and produces a signal at output terminal 45 which is the algebraic combination. In other words, the comparator 42 is an algebraic summing circuit, a type of circuit well known in various sensitivities, powers and signal ranges, to those skilled in the art. Typical of this type of circuit, the output signal varies in both magnitude and direction, the magnitude being dependent upon the difference between the actual phase angle and the intended phase angle of the feeder, and the direction, or polarity, depending upon whether the actual position of the feeder is lagging or leading the intended position. The control signal, suitably amplified by the amplifier 46, is fed correctively to the motor 23. That is, if the feeder is lagging the motor is accelerated and if the feeder is in leading phase, the motor is decelerated so that the actual phase position tends to constantly correspond to the intended phase position. Carrying out the invention in one of its aspects, the motor 23 is described as "powerful". By this term it is simply intended to mean that the motor has sufficient torque so as to be capable of immediate and forceable acceleration when acceleration is called for and immediate and forceful deceleration in the event that the feeder may instantaneously be in a leading relation. In a practical printing press of medium size employing a rotary feeder of the drum type the motor may, for example, have a normal rating of 55 horsepower.

In order to achieve good "following" between the actual and intended phase of feeder motion and to keep the horsepower of the motor 23 within reasonable limits, the comparator 42 which generates the control signal preferably includes means for augmenting the control signal to prevent hunting and overshoot thereby improving dynamic response, a matter well within the skill of the art. That is, the comparator may, if desired, include known means (not shown) for deriving first and second derivatives of the net input signal tailored to the combined inertia of the feeder and the motor armature which drives it. As is well known, provision may be made for manual adjustment of the first and second derivative signals until close following with substantially dead beat operation is achieved.

By using a drive system of the type shown in FIG. 2, and as described above, the feeder may be programmed to a wide range of velocity from at or about a dead stop for the purpose of picking up the sheet from the table and full press speed suitable for transfer of the sheet to the moving impression cylinder which, in a modern press, may operate at speeds as high as 180 revolutions per minute. This is accomplished without the wear noise and vibration which is encountered, particularly at high speed, in systems where the sheet feeder is mechanically coupled to the press drive through gears, cams and levers.

To facilitate understanding the present system has been described in a form in which the signal from the angle coder connected to the compression cylinder is subjected to a programmed offset signal (52 in FIG. 3) and such programmed offset signal, representing the intended position of the feeder, is algebraically combined with the signal from the angle coder connected to the feeder to achieve a control signal which is amplified and correctively applied to the motor. However the invention is not limited to such specific arrangement and, if desired, the programmed offset may be applied to the signal from the angle coder which is connected to the sheet feeder. In short, the programmed phase offset device 41 may be placed in line 37 rather than in line 33 (FIG. 2) but in such event the program would have to be modified so that the offset is applied in the opposite direction, a matter well within the skill of the art.

In both of the circuit possibilities mentioned above one of the angle coder signals is converted, that is, subjected to a programmed constantly varying offset, and algebraically compared with the signal from the other angle coder. This, however, is only one way of viewing the invention. The invention may also be viewed as establishing a certain predetermined positional but constantly varying phase relationship between the signals (in lines 33 and 37) representative of the phase relation between the street sheet feeder and impression cylinder and continuously comparing such relationship to a programmed relationship which should exist between the two, and producing a control signal which is representative of any current difference between the two relationships, which control signal is applied in corrective fashion to the driving motor.

It is, above all, an element of the invention in one of its aspects that the electric drive motor 23 is kept entirely independent of the press drive 14 so that the feeder is not only driven in a currently desired phase relation to the impression cylinder but that any changes in the loading upon the motor resulting from the acceleration and deceleration of the feeder are entirely isolated from the press drive so that the latter may rotate at a speed which is highly constant to achieve printing of the very highest quality.

I claim as my invention:

1. In a sheet fed printing press the combination comprising a set of cylinders including an impression cylinder having grippers for gripping the sheet during the printing thereof, a press drive directly coupled to the cylinders for driving them at a substantially constant speed, a feed board arranged opposite the impression cylinder and having means for positioning a sheet with its leading edge in a predetermined stationary position for pickup, a rotary sheet feeder interposed between the feed board and the impression cylinder for sequentially (a) picking up the leading edge of the sheet from its stationary position and (b) transferring the leading edge of the sheet to the grippers on the moving impression cylinder, a high powered electric motor for driving the sheet feeder, means including high resolution pickup heads and associated angle coders respectively coupled to the impression cylinder and sheet feeder for producing output signals representative of the phase position of the cylinder and sheet feeder, programmed phase offset means defining a predetermined relation of desired feeder phase as a function of impression cylinder phase, comparator means accepting the angle coder outputs for constantly comparing the (1) relation of the signal from the sheet feeder angle coder to the signal from the impression cylinder angle coder to (2) the desired relation stored in the programmed phase offset means and for producing a control signal which is representative of any current difference between the two relations, and an amplifier interposed between the comparator means and the electric motor for correctively energizing the motor so that the feeder is driven in the currently desired phase relation to the impression cylinder, the motor being entirely independent of the press drive so that the changes in the loading upon the motor resulting from the acceleration and deceleration of the sheet feeder are isolated from the press drive permitting the latter to rotate at the said constant speed.

2. In a sheet fed printing press the combination comprising a set of cylinders including an impression cylinder having grippers for gripping the sheet during the printing thereof, a press drive directly coupled to the cylinders for driving them at a substantially constant speed, a feed board arranged opposite the impression cylinder and having front and side stops for positioning a sheet with its leading edge in a predetermined stationary position for pickup, a rotary sheet feeder interposed between the feed board and the impression cylinder and having transfer grippers thereon for sequentially (a) picking up the leading edge of the sheet from its stationary position and (b) transferring the leading edge of the sheet to the grippers on the moving impression cylinder, a high powered electric motor for driving the sheet feeder, means including high resolution pickup heads and associated angle coders respectively coupled to the impression cylinder and rotary sheet feeder for producing output signals representative of the angular phase position of the cylinder and feeder, a programmed computer having inputs connected to the angle coders and having means for offsetting one of said output signals with respect to the other output signal algebraically to produce an offset signal which varies in accordance with a predetermined program representative of a corresponding desired constantly changing phase position of the sheet feeder, a comparator for constantly comparing the offset signal with the said other output signal for producing a control signal which is representative of the instantaneous algebraic difference between the two, and an amplifier interposed between the comparator and the electric motor for correctively energizing the motor so that the feeder is driven in the desired constantly changing phase relation to the impression cylinder, the motor being entirely independent of the press drive so that the changes in the loading upon the motor resulting from the acceleration and decleration of the sheet feeder are isolated from the press drive permitting the latter to rotate at the said constant speed.

3. In a sheet fed printing press the combination comprising a set of cylinders including an impression cylinder having grippers for gripping the sheet during the printing thereof, a press drive directly coupled to the cylinders for driving them at a substantially constant speed, a feed board arranged opposite the impression cylinder and having front and side stops for positioning a sheet with its leading edge in a predetermined stationary position for pickup, a rotary sheet feeder interposed between the feed board and the impression cylinder and having transfer grippers thereon for sequentially (a) picking up the leading edge of the sheet from its stationary position and (b) transferring the leading edge of the sheet to the grippers on the moving impression cylinder, a high powered electric motor for driving the sheet feeder, means including high resolution pickup heads and associated angle coders respectively coupled to the impression cylinder and rotary sheet feeder for producing output signals representative of the angular phase position of the cylinder and feeder, a programmed converter connected to the impression cylinder angle coder having an input and an output and including means for constantly converting the input signal representative of the angular position of the impression cylinder to a reference output signal representative of a corresponding desired constantly changing phase position of the sheet feeder, a comparator for constantly comparing the (1) reference output signal with (2) the signal from the sheet feeder angle coder for producing a control signal which is representative of the instantaneous algebraic difference between the two, and an amplifier interposed between the comparator and the electric motor for correctively energizing the motor so that the feeder is driven in the desired constantly changing phase relation to the impression cylinder, the motor being entirely independent of the press drive so that the changes in the loading upon the motor resulting from the acceleration and deceleration of the sheet feeder are isolated from the press drive permitting the latter to rotate at the said constant speed.

4. In a sheet fed printing press having a set of cylinders including an impression cylinder driven in synchronism with a press drive, the impression cylinder having grippers for gripping the sheet during the printing thereof, and the printing press having a feed board having sheets the leading edges thereof being successively in a predetermined position for pickup, an apparatus for feeding the sheets from the feedboard to the impression cylinder grippers comprising, in combination, a rotary sheet feeder for picking up the leading edge of a sheet positioned on the feedboard and transferring the leading edge of the sheet to the grippers on the moving impression cylinder, said mechanical means moving through a programmed cycle of positions for the feeding of each sheet, means including an electric motor for periodically driving the rotary sheet feeder through its predefined cycle of positions at a velocity regulated by an electrical drive control signal, means for measuring the phase of said rotary sheet feeder in its predefined cycle of positions and generating an electrical feed phase signal, means for measuring the phase of the impression cylinder and generating an electrical impression cylinder phase signal, electrical means for comparing the electrical feed phase signal to the electrical impression phase signal and generating the electric drive signal in response to any departure of the electrical feed phase signal from synchronism with a programmed function of the electricl impression cylinder phase signal, said programmed function being selected so that said rotary sheet feeder moves through its programmed cycle of positions for the feeding of each sheet when said electrical feed phase signal is in synchronism therewith, the motor being entirely independent of the press drive so that the changes in the loading upon the motor resulting from the acceleration and deceleration of the sheet feeder are isolated from the press drive permitting the latter to rotate at the said constant speed.

* * * * *